US006389789B1

(12) United States Patent
Preininger et al.

(10) Patent No.: US 6,389,789 B1
(45) Date of Patent: May 21, 2002

(54) THREAD WITHDRAWAL NOZZLE FOR AN OPEN-END SPINNING APPARATUS

(75) Inventors: Heinrich Preininger, Waldbronn; Heinz Müller, Metzingen-Neuhausen, both of (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 09/759,381

(22) Filed: May 25, 2001

(30) Foreign Application Priority Data

Jan. 15, 2000 (DE) ..... 100 01 468

(51) Int. Cl.[7] ..... D01H 4/440
(52) U.S. Cl. ..... 57/417; 57/352
(58) Field of Search ..... 57/417, 352, 414, 57/404, 406, 407, 408, 411, 413

(56) References Cited

U.S. PATENT DOCUMENTS 3,986,332 A * 10/1976 Fukuda et al. ..... 57/417
4,166,354 A 9/1979 Duba
4,665,687 A * 5/1987 Ott et al. ..... 57/417
4,702,069 A * 10/1987 Maximov et al. ..... 57/417
4,932,202 A * 6/1990 Landwehrkamp ..... 57/417
5,265,406 A * 11/1993 Hofmann et al. ..... 57/417
5,402,630 A 4/1995 Stephen et al.
5,423,177 A * 6/1995 Raasch ..... 57/417
6,035,625 A * 3/2000 Schomer et al. ..... 57/417

FOREIGN PATENT DOCUMENTS

DE 2526079 12/1976
DE 3103284 A1 8/1982
DE 3634567 A1 10/1987
DE 4010140 A1 10/1991

OTHER PUBLICATIONS

German Patent Office Search Report, May 29, 2000.

* cited by examiner

*Primary Examiner*—Danny Worrell
(74) *Attorney, Agent, or Firm*—Dority & Manning

(57) ABSTRACT

For the formation of a thread withdrawal nozzle for an open-end spinning apparatus which possesses a spin rotor, a thread contact surface (32) of the nozzle is provided with projections (36), which projections close at an obtuse angle ($\alpha$) with the thread contact surface (32). Thereby, a satisfactory twist propagation is obtained to the fiber entwinement point, so that, in this manner, a softer thread can be produced. Advantageously, the thread is not roughened by this treatment.

24 Claims, 1 Drawing Sheet

THREAD WITHDRAWAL NOZZLE FOR AN OPEN-END SPINNING APPARATUS

BACKGROUND

The present invention concerns a thread withdrawal nozzle for an open-end spinning apparatus.

Where open-end spinning is involved, the best thread results are obtained when a thread withdrawal nozzle with a smooth surface is employed. These favorable thread characteristics, however, can only be attained if the thread being withdrawn is strongly twisted. Only with this hard twisted thread, does it become possible to propagate the twisting taking place in the thread withdrawal nozzle back to the point of fiber entwinement. The produced thread, on this account, feels hard to the touch.

In order to improve the propagation of the twist, it is a known practice to provide in the thread change of direction area of the thread withdrawal nozzle, larger projections (DE 31 03 284 A1) or smaller recesses in the form of notches (DE 42 35 024 A1). By these means, the thread is set into vibration during its withdrawal, so that it intermittently contacts the thread removal nozzle inner surface with less force. This enables the achievement that the twisting can propagate itself better from the axial zone of the thread withdrawal nozzle back to the fiber entwinement point of the spinning rotor. Such an arrangement is favorable to the consolidation of the fibers collected on the rotor and an improvement in entwinement is gained. This known thread withdrawal nozzle, with more or less large, i.e. broad, recesses between the projections, indeed leads to such a point that the thread is enabled to exhibit less of a twist. The "less" means in comparison with such threads as simply run over a very smooth surface on the thread withdrawal nozzle.

In any case, these projections act, between the larger cut sections or between the narrower notches, very aggressively on the thread which finds itself in the process of withdrawal. An additional fact is that it is not possible to polish or fine-finish the recesses. These profiled thread withdrawal nozzles lead, on this account, to a very rough thread. Further, especially in the case of notches, these openings over time, become clogged, so that their effect on the thread in its state of formation changes, which has a negative result on the spun strength.

OBJECTS AND SUMMARY

Thus a principal purpose of the present invention is to create a thread withdrawal nozzle which enables a good twisting propagation back to the fiber entwinement point, so that a softer thread can be produced without an accompanying roughing of the thread and without changing the conditions of spin when spinning is in operation.

In accord with the features of an embodiment of the invention, a thread withdrawl nozzle is provided for an open-end spinning apparatus possessing a spin rotor, said nozzle having an axial boring, onto which, on the side proximal to the spin rotor, a thread contact surface is attached, on which a thread slides during the withdrawl of said thread out of the spin rotor and in a specified direction of thread travel, therein characterized, in that the thread contact surface possesses several ring-like arranged projections, which respectively between their sides and the thread contact surface, as seen in the direction of travel of the thread, close an obtuse angle $\alpha$. The projections therein stated aid the twisting propagation, without aggressive action being necessary against the thread, as is the case in the state of the known technology. Much more, the projections act very gently on the thread, so that the surface thereof, during an imparted vibratory motion, is not, or is nearly not, in essence, impaired. Lesser twisting is required for the incorporation of fibers into the thread end, because of the improved twisting propagation in the axial zone of the thread withdrawal nozzle, and there is gained from this situation a soft thread with a smooth surface.

In order, during the imparting of the vibration, not to act too strongly and aggressively, but nevertheless effectively, on the thread, experience has shown, that the invented thread withdrawal nozzle can be further developed wherein the enclosed angle ($\alpha$) between the side of the projection and the thread contact surface is greater then 110°. The angle ($\alpha$) may increase from a side in a direction to the end of the projection remote from the thread contact surface. In one embodiment, the projections exhibit an essentially domed shape or cup-like shape. In this manner, the transitions of the surfaces, with which the thread being withdrawn comes in contact, are not too abrupt, are nicely fared, and protective of the thread. Purposefully, in this respect, a development of the said projections is proposed wherein the projections are constructed from inserted spheres in a partial area of the thread contact surface. The spheres may be non-rotatably affixed.

Experiments have demonstrated that it is of value to dimension the nozzle with a diameter of the domed projection measuring essentially between 1 and 4 mm. The protrusion of the projection relative to the thread contact surface mat be smaller than one-half of the diameter of the bottom surface of the projection which rests on said thread contact surface. The protrusion may not to exceed 0.3 mm. The projections may at least partially rise above a plane in which is located the front surface of the thread withdrawl nozzle proximal to the spin rotor.

Particularly advantageous is a design of the projection wherein the projections, in relation to the thread travel direction, possess, downstream, a steep side, since by means of such a design, the twist propagation completely back to the fiber entwinement point is additionally favored.

By means of an improvement of the thread withdrawal nozzle, wherein the ring-like arranged projections are appointed at equal intervals on the thread contact surface or, the projections are located, at least partially, in a transition zone, the achievement is attained, that in spite of a protective treatment of the thread during the imparting of vibration, a uniform twist propagation back to the fiber entwinement point is gained. Experience has shown, that in the case of the customary size of thread withdrawal nozzles, the arrangement of the projections wherein the diameter pf the circle, on which the projections are placed possesses a value which approaches that of the diameter of the impact plate may be advantageous. The diameter of the circle, on which the projections are placed may be between 7 mm and 12 mm.

For the attainment of a good propagation of twist leading out of the axial longitudinal zone of the thread withdrawal nozzle and back to the fiber entwinement point on the fiber collection surface of the spinning rotor, it is possible to provide different numbers of projections on the radial thread contact surface. However, practice has indicated that too many projections offer no advantage. On this account, it is more practical have a maximum of eight projections, for example four such projections.

Although it is true, that the projections provide a uniform and long lasting influence on the thread while it is forming and being withdrawn, it is of advantage, if, by means of additional measures this said lengthy, unchanging practice is given support. For example, the projections may have an abrasion resistant or polished surface.

The object of the invention can be manufactured in a simple and economical manner. Further, it may be installed by a simple exchange of the previously conventional thread withdrawal nozzle. In spite of the soft action, as compared to the known state of the technology, the invented withdrawal nozzle assures the required vibratory motion and the necessary propagation of the twisting from its place of origin back into the fiber entwinement point, where the twisting is needed. Thereby a smooth and soft thread is produced with good characteristics such as tensile strength, etc. Contrary to the state of the technology, the action of the invented projections does not change with time, since the projections are self cleaning and do not allow deposition of the fibers or the like.

In the following, design examples of the invention are explained with the help of drawings.

DETAILED DESCRIPTION

Figure 1:
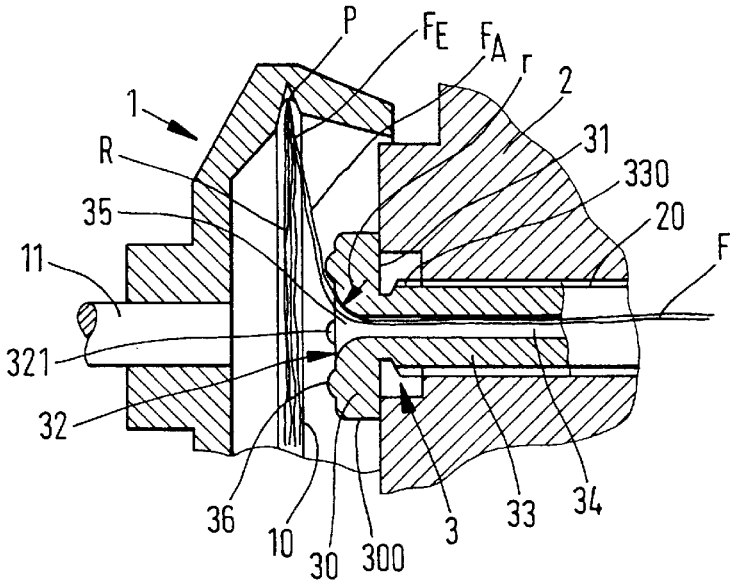
FIG. 1 in longitudinal section, a thread withdrawal nozzle designed in accord with the invention, as well as a part of the rotor cover which carries said nozzle and the spin rotor, FIG. 2 the thread withdrawal nozzle of FIG. 1 as seen in front view, and FIG. 3 in side view, a detail of the invented thread withdrawal nozzle.

Reference will now be made in detail to embodiment of the invention, one or more examples of which are illustrated in the drawings. The examples are provided by way of explanation of the invention, and not as a limitation of:the invention. Modifications and variations can be made to the embodiments described herein without departing from the scope and spirit of the invention.

FIG. 1 shows those elements principally necessary for an understanding of the invention where an open-end apparatus designed on the rotor spinning basis is concerned. These elements include a spin rotor 1, which is designed in a known manner and is placed on a shaft 11, by which it is rotatingly driven in a conventional manner, which thus needs no description. The spin rotor 1 possesses in a conventional way, a fiber collection groove 10, in order to gather fibers (not shown). The fibers, gathered and laid down in the fiber collection ring groove 10 form, during the spinning operation, a fiber ring R. This fiber ring R stands in connection with a thread F at a fiber entwinement point P. This thread is continually drawn out of the spin rotor 1 and wound on a core for the construction of a spool (not shown).

The spin rotor 1 is located in a (not shown) housing, which is covered by a rotor cover 2. This possesses, centrally placed, a thread withdrawal nozzle 3, onto which a (not shown) thread removal conduit connects, as a rule, to that side of the nozzle 3 remote from the spin rotor 1.

The thread withdrawal nozzle 3 possesses a disk-like thread impact plate 30, which lies against the rotor cover 2 with its annular back surface 31.

The annular surface 31 of the thread withdrawal nozzle 3 extends radially inward to a fastening sheath 33, which is further designed as an integrated component of the thread withdrawal nozzle 3. This said sheath 33 serves for the fastening of the thread withdrawal nozzle 3 onto the rotor cover 2 and, for this purpose, extends itself into said rotor cover 2.

Normally, the fastening sheath 33 possesses a male thread 330, which threadedly engages in a matching female thread 20 of the rotor cover 2. Other means of engagement between the thread withdrawal nozzle 3 and the rotor cover 2 are possible, for instance, this can be done in the manner of the bayonet closure, or the like. Also it is not a requirement, to affix the thread withdrawal nozzle 3 directly to the rotor cover 2, but the fastening can be accomplished with the help of a interposed piece (not shown).

The fastening sheath 33 of the thread withdrawal nozzle 3 exhibits an axial boring 34, which extends through to that side of the thread withdrawal nozzle 3 proximal to the spin rotor 1 and there converts to a thread contact surface 32, from which a transition zone 35 is constructed in the form of a funnel, in order to make possible a stepless change of direction of the thread subjected to withdrawal.

Figure 2:
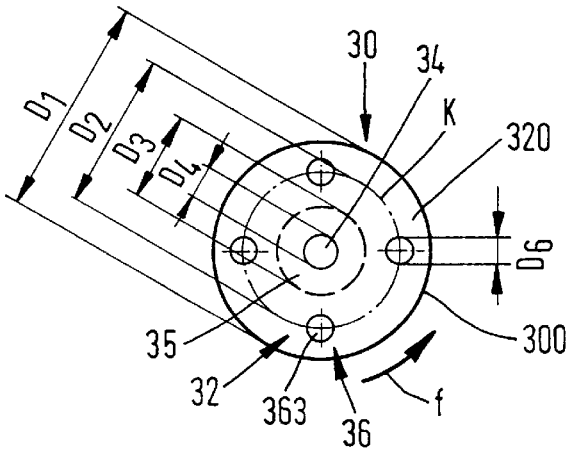
Figure 3:
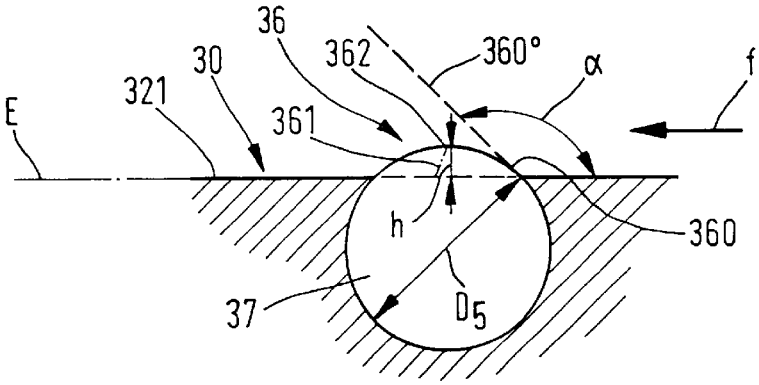

The thread contact surface 32 of the thread withdrawal nozzle 3 possesses, in accord with the embodiment shown in FIG. 2, four projections 36. These four projections 36 are respectively located in a ring, and are uniformly apportioned in a common circle K placed concentric to the axial boring 34. The projections 36 narrow themselves in proportion to increasing distance from the thread contact surface 32 in a direction toward their exposed ends 362, (FIG. 3), which said ends are remote from the thread contact surface 32. That is to say, the projections 36 close between their sides 360 adjacent to the thread contact surface 32 and the said thread contact surface 32 an obtuse angle $\alpha$. This angle $\alpha$ is shown in FIG. 3 to make a more clear presentation thereof in connection with a tangent 360' of the side 360.

During the process of spinning, the thread F, which is being subjected to withdrawal, is positioned with its thread end $F_E$ (FIG. 1) in the area of the fiber entwinement point P in connection with the fiber ring R, which, in its customary way, is continually building up and binds into the thread end $F_E$. To this purpose, the thread F, during production, is continually being twisted around its own axis. This occurs in the case of a rotor spinning apparatus in a known manner, because the spin rotor 1 rotates at a high speed of rotation.

Because of the thereby induced centrifugal force, the thread end $F_E$ lies on the inside wall of the spin rotor 1 in the zone of the rotor's fiber collection groove 10. By this action, the thread end $F_E$, is picked up by the rotation of the spin rotor 1 and acts as a crank, which imparts a rotation to the thread. This is possible, because the thread end is already axially aligned with the axial boring 34 of the thread withdrawal nozzle 3 that is to say, aligned in a thereto connected, small diameter, thread withdrawal tube (not shown). So that the thread end $F_E$ can entwine with the fiber ring R, it is necessary, that the twisting is propagated from the mentioned axial zone into the fiber entwinement point P.

Before the thread withdrawal nozzle 3, which has been described above as to its construction, is further explained as to its function, it would be well in the following to describe first the function of (not shown) thread withdrawal nozzle 3, which is in accord with the known state of the technology. In accord with this state of the technology, a thread withdrawal nozzle 3 is either used, first, with a smooth thread contact surface 32, or second, with a thread withdrawal nozzle 3 which has in this area, notches or projections. In the first case, the thread F, which is being withdrawn, moves continuously over the said thread contact surface 32 of the thread withdrawal nozzle 3. In the second case, the thread F is brought through the notches or projections in such a way, that it is periodically released from its under support, i.e. the thread contact surface 32. Under this circumstance, the twisting can propagate itself in the direction of the fiber entwinement point P. In any case, the thread F is very severely treated by the projections, or the sidewalls of the notches, to the end that the thread has no smooth surface, but, on the contrary, comes through very fuzzy.

Now, the present design will be described, with the aid of the described design presented in FIGS. 2, 3, regarding a thread withdrawal nozzle 3 with projections 36 on its thread contact surface 32. The thread section $F_A$ is that part of the thread F, which is in the process of withdrawal. This said thread section $F_A$, which extends itself from the fiber collection surface 10 of the spin rotor to the axial boring 34 of the thread withdrawal nozzle 3, runs over the thread contact surface 32 of the thread withdrawal nozzle 3.

As it does this, the thread section $F_A$ reaches a side contact on one of the projections 36. The rotating thread section $F_A$ is then lifted by said projection 36 from the thread contact surface 32. Due to the diminishing shape of the projection 36, this lifting of the thread section $F_A$ completes itself in a protective manner for the said thread section $F_A$ which is undergoing the withdrawal procedure. Thus, the thread retains a smooth surface, as this was also the case in the use of the previously employed thread withdrawal nozzles which had polished thread contact surfaces. In comparison to, and contrary to the previously employed thread nozzles, a less severe twisting suffices for the certain entwinement of the fibers with an increased spun stability, which can be attributed to the fact, that the thread section $F_A$ is periodically raised away from the thread contact surface 32 by means of the projections 36. In this manner, the twist propagation from the axial zone inside the axial boring 34 of the thread withdrawal nozzle 3 back to the fiber entwinement point P of the fibers is made more feasible. After the release of the thread section $F_A$ by means of one of the projections 36, the rotating thread section $F_A$ circularly slides over thread contact surface 32 of the thread withdrawal nozzle 3 until the said thread section $F_A$ reaches the next projection 36, whereupon this procedure repeats itself.

Within the framework of the present invention, the described thread withdrawal nozzle can be altered in a multitude of ways, in which, for example, individual features can be replaced by equivalents, or by other combinations of features and equivalents. Thus, in accord with the given example, there are placed, on the circle K, a total of four projections 36, yet it is self evident, that also, in accord with the purpose of the application, (worked-up fiber material, rotor RPM, thread withdrawal speed, etc.) a different number of projections 36 can be evenly distributed over the circumference of the thread contact surface 32. Thus, dependent upon the specific spinning conditions, there may be provided even fewer projections, for instance three, or yet more, for instance six or eight. If too few projections 36 are provided, then the thread F is not raised sufficiently often enough above the thread contact surface 32, in order to allow the propagation of the necessary number of twists to the fiber entwinement point.

Yet if too many projections 36 are provided, then this impairs the formation of sufficiently great vibration amplitudes and therewith likewise limits the twisting propagation. Contrary to grooves, the projections 36 allow a simple mode of manufacture. For this purpose that mode can be integrated components of the thread withdrawal nozzle 3 or just as well inserted elements, as will be more exactly defined later with an embodiment example. The projections 36 are self cleaning, since the rotating thread section $F_A$, in its circular motion, can "take-along" any fiber particles which could possible settle out on a projection 36.

The projections 36 can, in principle, be of various shapes. If conditions call for it, even on the same thread contact surface 32 of a thread withdrawal nozzle 3, differently shaped projections 36 can be employed. Still, on the grounds of simplified manufacture, preference is given to an arrangement where all projections 36 of a thread withdrawal nozzle 3 are of one and the same shape. The projections 36 can, for instance, possess a cross section which is trapezoidal is shape (not shown), whereby their slant sides meet the respective thread contact surface 32 making an obtuse angle $\alpha$. This type of a shaped projection 36 with a linear shape can extend itself, in relation to the thread contact surface 32, independently of its special form, in a radial direction. That is, the direction of extension can be in the circumferential direction of the thread impact plate 30 or even in another direction.

The projections 36 can also exhibit a multiplicity of sides 360, the angle $\alpha$ of which against the thread contact surface 32 increases by stages in proportion to the distance of each side from the said thread contact surface 32 (not shown). For instance, in the shape of two stages, whereby the angle $\alpha$ in the first stage is in immediate contact with the thread contact surface 32, is for instance, 150° and in the second stage, which is separated by the first stage from the thread contact surface 32, is perhaps 160°. Further, instead of a trapezoidal form, with said staged angle transitions, the projections 36 can possess even a dome shaped protrusion, so that the angle $\alpha$ from the side 360 to the end 362 increases in a stepless manner (FIG. 3). In this case, the projections 36 can be of an inverted cup shape, that is, hemispherical, which, in regard to their manufacture, is of considerable advantage.

Especially, when the projections 36 at least partially penetrate the plane E, in which is found the face 321, which is proximal to the spin rotor 1 and part of the thread withdrawal nozzle 3, these projections 36 are of immediate access, especially for the treatments for an increased resistance to abrasion or for achieving a particularly fine surface. In this regard, a known procedure can be employed, for instance annealing and/or polishing.

As already mentioned, it is not necessary, that the projections 36 be integrated components of the thread withdrawal nozzle 3. Instead of this, the projections 36 can be designed in the form of inserts, which again, principally within the limits of the above outlined conditions, can be of various shapes. As such inserts, for example spheres 37 (FIG. 3) can be used. Applicable spheres are obtainable on the market with abrasion resistant and polished surfaces at favorable prices. A partial area of such a sphere 37 extends beyond the thread contact surface 32 and so forms the projection 36. These spheres 37 are inserted into the thread contact surface 32 in corresponding borings or recesses therein. The spheres 37 may be so held in a rotatable or non rotatable condition. Since it is already known how such rotatable or non-rotatable seatings appear, in the illustrated presentations a detailed drawing thereof has been dispensed with.

Experience has shown that the non-rotatable seating of the spheres 37 leads to more consistent results, since, by such seating, there is no requirement for fissures, openings, or the like wherein fibers, fiber remnants or the like can lodge.

As already mentioned above, the projections 36 are mounted in a ring, i.e. a circle K (FIG. 2). This mounting is independent therefrom, as to whether these are integrated components of the thread impact plate 30 of the thread withdrawal nozzle 3, or installed as inserts placed in the thread contact surface 32, in the shape of a ring. The diameter $D_2$ of the circle K can, in this matter, be differently dimensioned, and is dependent upon the desired thread characteristics. In proportion to the value of the radius of curvature r (FIG. 1) of the transition zone 35 and/or the diameter $D_1$ of the impact plate 30, the circle K can be placed still within this said transition zone 35, that is, within the outer side defined by the diameter $D_3$, so that the projections 36 find themselves entirely or partially in said transition zone 35. The circle K, however, can be located in one of the ring surfaces 320 surrounding the transition zone 35 of the thread contact surface 32. In the change of direction and the transition zone 35, the thread F is pressed against the projections 36 with greater force, so that an effective imparting of vibration is achieved. Because of the obtuse angle α with an advantageous measurement between 110° and 160°, advantageously, a too aggressive effect on the thread F is avoided. It is also possible, by means of an angle α of 160° or greater to modify the imparting of vibration to be somewhat softer, without interfering with the effectivity thereof.

The previously mentioned ring surface 320 need not be unconditionally furnished. With a corresponding determination of an increase in the radius of curvature r for the transition zone 35, this can extend itself to the outer rim 300 of the impact plate 30, so that the outside diameter $D_3$ of the transition zone 35 is equally as great as is the outside diameter $D_1$ of said impact plate 30. In this case, the projections 36 become placed in the transition zone 35. If the diameter $D_2$ of the circle K increases as to approach the diameter $D_1$ of the impact plate, allowing the projections 36 to protrude through the plane E of the already mentioned thread contact surface 32, then said projections 36 are easily accessible for a possibly required rework, such as polishing.

Following the usual dimensions used today for thread withdrawal nozzles 3, a diameter D2 of essentially 11 mm has proven itself as advantageous for the circle K.

For the spheres 37, which are placed as inserts in the impact plate 30, a diameter $D_5$ (FIG. 3) of between 1 and 4 mm is seen as favorable, since spheres 37 of this size allow themselves to be fastened particularly well in the impact plate 30 in such a manner, that they protrude from the thread contact surface 32, and in so doing, the side 360 of that part of the sphere 37 which forms the projection 36, joins with the thread contact surface 32 at the desired obtuse angle α.

The projections 36 do not need to rise too far from the thread contact surface 32. A height h in of the general dimension of 0.1 to 0.3 mm has shows itself to be effective. If the protrusion exceeds the rise of about 0.3 mm, then, as a rule, especially in the employment of a cup-like part of the sphere 37 as a projection 36, the angle α between the side 360 and the thread contact surface 32 moves in an acute direction. The effect of this upon the thread F is increasingly more aggressive, which leads to a roughening of the outer surface of the produced thread F. On the other hand, if the protrusion is too small, which, as a rule, is anything under 0.1 mm, then the effectivity of the projections 36 diminishes, so that the desired propagation of the twisting back to the fiber entwinement point R, is too little.

The maximum value of the extent of the protrusion h depends, naturally, on the shape of the projections 36. If such a projection 36, for example, is formed by a partial section of a sphere 37, then the corresponding angle α, at a given height of the protrusion h, is just so much smaller, the smaller the diameter $D_5$ of the sphere 37 is, and conversely, just so much greater, the greater the diameter $D_5$ of the sphere 37 is. In other words, the smaller, at a given height of the protrusion h, the diameter $D_5$ of the sphere 37 is, just so much more steep is the inclination at side 360 of the protrusion 36, upon which the thread F runs, which thread is running over the thread contact surface 32. Further, the greater this given height of the protrusion h of the diameter $D_5$ of the sphere is, just so much flatter does the inclination of the side 360 fall. From these named grounds, it becomes desirable to dimension the protrusion height h in such a way that it is less than half the diameter $D_6$ of the base surface 363 of the projection 36, whereby this base surface 363 is found in the plane E of the thread contact surface 32.

A particular effort is made to set the thread F into vibration in a protective manner, in order that, by means of the produced vibration, periodic lifting of the thread F from the thread contact surface 32 will ease the propagation of the twist forming in the axial boring 34 back to the fiber entwinement point P, so that for this twisting propagation a small twisting in the produced thread F is sufficient (in comparison to a smooth thread contact surface 32) and in this way a softer thread F can be produced.

This protective activity in favor of the thread F is attained principally in that the running thread, during its withdrawal passes over the thread contact surface 32, is, in a gentle manner, lifted from the thread contact surface periodically by the projections 36.

As has been explained above, the sides 360, over which the thread F runs during its twisting (see thread change of direction f in FIGS. 2, 3), close an obtuse angle with the thread contact surface 32. Experience has shown that it is of especial advantage for this angle α to be provided with a value greater than 150°. By this means, first the thread F is lifted periodically from the thread contact surface 32 without any great stress or pullback action and second, the thread F is brought to satisfactory vibration, in order to assure that the desired twisting propagation is brought back to the fiber entwinement point P.

In case it is desirable, the previously described activity can yet be supported, in that the projections 36, respectively on that side from which the moving thread F leaves the projections 36, show a steep incline at the side 361 (FIG. 3), so that the thread F, upon leaving a projection 36 is abruptly released, which is favors the twisting propagation. Because of this, and also by a renewed touching of the thread contact surface 32, the thread F which is in the process of withdrawal, is subjected to no sudden back pull, and exhibits a smooth surface with a soft twist.

If, on the thread release side of the projection 36, a steeply inclined side effect 361 is provided for a sudden release of the thread F, then it is possible to have the projection 36 lift the thread so softly from the contact that no aggressive plucking action is rendered against the thread F. This is done by providing a correspondingly long and flat inclination side 360 on the thread feed side (see thread movement direction in FIGS. 2 and 3). The projection 36, in such a case, is longitudinally constructed and possibly curved in the circumferential direction of the circle K, so that the side 360 can be correspondingly flatly designed. Upon release, the thread F will in no case be subjected to any restraining force, so that, again, the thread F retains its smooth appearance.

Principally, it is not a requirement that the projections 36 be apportioned uniformly around the circle K, but still such a uniform distribution of said projections 36 provides a particularly even apportionment of vibration and thus also contributes to twist propagation. Giving consideration to the dimensioning of a preferred embodiment of the invented thread withdrawal nozzle, the said embodiment possesses a radius of curvature r of 3.5 mm, a radius of 1 mm in the area of the hemispherical projections 36 and diameter $D_2$ of 11 mm, where the protrusion h of the said projections showed 0.3 mm.

It should be appreciated by those skilled in the art that various modifications and variations can be made to embodiments of the invention described herein without departing from the scope and spirit of the invention as set forth in the appended claims and their equivalents.

What is claimed is:

1. A thread withdrawal nozzle for an open-end spinning device having a spin rotor, said nozzle comprising a thread contact surface on a side proximal to the spin rotor on which a thread slides during formation and withdrawal of the thread from the spin rotor, said thread contact surface comprising a plurality of projections extending therefrom over which the thread slides, said projections comprising a first side forming an obtuse angle with said thread contact surface as seen in the direction of travel of the thread over said thread contact surface, said projections disposed in at least one concentric ring pattern on said thread contact surface.

2. The thread withdrawal nozzle as in claim 1, wherein said projections are arranged equally spaced around a circumference of said ring pattern.

3. The thread withdrawal nozzle as in claim 1, wherein said ring pattern has a diameter between about 7 mm and about 12 mm.

4. The thread withdrawal nozzle as in claim 1, wherein said obtuse angle is greater than about 110 degrees.

5. The thread withdrawal nozzle as in claim 1, wherein said projections comprise an essentially dome-like shape.

6. The thread withdrawal nozzle as in claim 1, wherein said projections comprise an essentially cup-like shape.

7. The thread withdrawal nozzle as in claim 1, wherein said projections are formed integrally with said thread contact surface.

8. The thread withdrawal nozzle as in claim 1, wherein said projections comprise insert members disposed at least partially in said thread contact surface.

9. The thread withdrawal nozzle as in claim 8, wherein said projections comprise spheres.

10. The thread withdrawal nozzle as in claim 9, wherein said spheres are non-rotatably set within said thread contact surface.

11. The thread withdrawal nozzle as in claim 1, wherein said projections comprise dome-like portions of spheres set at least partially into said thread contact surface, said spheres having a diameter at said thread contact surface between about 1 mm and about 4 mm.

12. The thread withdrawal nozzle as in claim 11, wherein said dome-like portions have a greatest height above said thread contact surface that is less than about one-half of a diameter of said dome-like portion measured at a plane of said thread contact surface.

13. The thread withdrawal nozzle as in claim 12, wherein said greatest height of said dome-like projections does not exceed about 0.3 mm.

14. The thread withdrawal nozzle as in claim 1, wherein said projections comprise dome-like shapes extending from said thread contact surface, said dome like shapes having a greatest height above said thread contact surface that is less than about one-half of a diameter of said dome-like portion measured at a plane of said thread contact surface.

15. The thread withdrawal nozzle as in claim 14, wherein said greatest height of said dome-like projections does not exceed about 0.3 mm.

16. The thread withdrawal nozzle as in claim 1, wherein said projections comprise a second side opposite from said first side in a direction of travel of the thread on said thread contact surface, said second side defining an angle with said thread contact surface that is steeper than said angle formed between said first side and said thread contact surface.

17. The thread withdrawal nozzle as in claim 1, wherein said nozzle further comprises an axial bore extending therethrough and a funnel-shaped transition zone defined between an end of said bore proximal to the spin rotor and said thread contact surface, said projections disposed at least partially in said transition zone.

18. The thread withdrawal nozzle as in claim 1, comprising a maximum of about 8 said projections.

19. The thread withdrawal nozzle as in claim 1, comprising about 4 said projections equally spaced concentrically on said thread contact surface.

20. The thread withdrawal nozzle as in claim 1, wherein said projections comprise an abrasion resistant surface.

21. The thread withdrawal nozzle as in claim 20, wherein said projections comprise a polished surface.

22. The thread withdrawal nozzle as in claim 1, wherein said nozzle further comprises an axial bore extending therethrough and a funnel-shaped transition zone defined between an end of said bore proximal to the spin rotor and said thread contact surface, said transition zone having a radius of curvature between about 0.1 mm and about 1.0 mm.

23. The thread withdrawal nozzle as in claim 22, wherein said projections are disposed radially beyond said transition zone on said thread contact surface.

24. The thread withdrawal nozzle as in claim 22, wherein said projections are disposed at least partially in said transition zone.

* * * * *